US009469811B2

(12) United States Patent
Hoppe et al.

(10) Patent No.: US 9,469,811 B2
(45) Date of Patent: Oct. 18, 2016

(54) TOOL FOR CRUSHING COKE

(71) Applicant: Ruhrpumpen GmbH, Witten (DE)

(72) Inventors: Thomas Hoppe, Witten (DE); Wolfgang Paul, Hamburg (DE); Kay Simon, Iserlohn (DE); Andreas Wupper, Recklinghausen (DE)

(73) Assignee: Ruhrpumpen GmbH, Witten (DE)

( * ) Notice: Subject to any disclaimer, the term of this patent is extended or adjusted under 35 U.S.C. 154(b) by 170 days.

(21) Appl. No.: 14/293,149

(22) Filed: Jun. 2, 2014

(65) Prior Publication Data

US 2015/0232761 A1 Aug. 20, 2015

(30) Foreign Application Priority Data

Feb. 17, 2014 (DE) ..... 10 2014 101 985

(51) Int. Cl.

| | |
|---|---|
| ***A62C 31/00*** | (2006.01) |
| ***C10B 43/08*** | (2006.01) |
| ***C10B 33/00*** | (2006.01) |
| ***B05B 1/16*** | (2006.01) |
| ***B05B 12/08*** | (2006.01) |

(52) U.S. Cl.

CPC ..... *C10B 43/08* (2013.01); *B05B 1/16* (2013.01); *B05B 1/1627* (2013.01); *B05B 12/085* (2013.01); *C10B 33/006* (2013.01); *Y10T 83/364* (2015.04)

(58) Field of Classification Search

CPC ... C10B 43/08; C10B 33/006; B05B 1/1627; B05B 1/16; B05B 12/085; Y10T 83/364

USPC ..... 239/71, 73, 442–444, 447

See application file for complete search history.

(56) References Cited

U.S. PATENT DOCUMENTS

| | | | | |
|---|---|---|---|---|
| 4,738,399 | A * | 4/1988 | Adams | B08B 9/093 239/447 |
| 5,816,505 | A * | 10/1998 | Tran | C10B 33/006 239/447 |
| 8,002,204 | B2 | 8/2011 | Paul et al. | |
| 2013/0093148 | A1 | 4/2013 | Schraeder et al. | |

FOREIGN PATENT DOCUMENTS

| | | |
|---|---|---|
| DE | 10 2007 063 329 | 6/2009 |
| DE | 102007063329 B3 | 6/2009 |
| DE | 10 2010 041 054 A1 | 10/2011 |

* cited by examiner

*Primary Examiner* — Steven J Ganey

(74) *Attorney, Agent, or Firm* — Bachman & LaPointe, PC

(57) ABSTRACT

The invention relates to a tool for crushing coke, and includes a housing 2 that, in an operating state, is fastened to a drill rod, and in which is arranged at least one cutting nozzle 10 for cutting and a drilling nozzle 9 for drilling coke by means of a water jet, and a control for supplying water flowing through the housing 2 under pressure for drilling or cutting, wherein the control for switching the tool 1 from a drilling mode to a cutting mode and vice versa includes a control device 7 that is rotatable about a longitudinal axis of the housing 2 to switch the tool 1, wherein the drilling or cutting mode is set depending on the angular position of the control device 7. To obtain a clear understanding of whether the tool 1 is in drilling or cutting mode, at least one position element 38, 39 is arranged on the control device 7 that displays the angular position of the control device 7 in the drilling and/or cutting mode of the tool 1 through a window 18 in the housing 2.

8 Claims, 5 Drawing Sheets

TOOL FOR CRUSHING COKE

BACKGROUND OF THE INVENTION

The invention relates to a tool for crushing coke comprising:

- a housing that, in an operating state, is fastened to a drill rod, and in which is arranged
- at least one cutting nozzle for cutting and a drilling nozzle for drilling coke by means of a water jet, and
- a control for supplying water flowing through the housing under pressure for drilling or cutting,
- wherein the control for switching the tool from a drilling mode to a cutting mode and vice versa comprises a control device that is rotatable about a longitudinal axis of the housing to switch the tool,
- wherein the drilling or cutting mode is set depending on the angular position of the control device.

In oil refineries, the last, otherwise no longer usable, fraction of crude oil is converted to coke. The conversion occurs by introducing this fraction into upright drums that have a large capacity and, for example, possess a height of approximately 40 m and a diameter of, for example, 8 m. The drums fill with coke over time during operation. When the maximum fill level of a drum is reached, the coke is cut out of the drum. This process, called "decoking", is performed with high-pressure water jets which crush the coke in the drum and flush it out of the drum.

A tool for generating the high-pressure water jets is fastened to a drill rod, to which water is supplied under high pressure, and the tool is introduced with the drill rod into the drum from above.

First, the tool, in so-called drilling mode, drills a continuous, coaxial opening from top to bottom, wherein the high-pressure water jets exit from drilling nozzles normally arranged at the bottom end of the tool in order to crush the coke. Then the tool with the drill rod is lifted and returned to the top end of the drum. At this location, the tool switches from drilling mode to cutting mode in which the path of flow of the pressurized water to the drilling nozzles is blocked, and instead, flow paths are released to the cutting nozzles that are located on the perimeter of the tool and from which the high-pressure water jets exit substantially perpendicular to the longitudinal axis of the tool and the drill rod, and crush the coke across the cross-section of the drum in a spiral path. The tool executes a rotary movement with the drill rod in drilling mode and in cutting mode as well. Coke crushed in this manner is rinsed out of the drum at the bottom.

The tool is switched from drilling mode to cutting mode and vice versa by rotating the control device by an angle required for the switchover that is usually 90°. The switchover is automatically triggered by significant reduction of the operating pressure of the water from approximately 300 to for example 15 bar as, for example is known from the document DE 10 2007 063 329.

The knowledge of whether the tool is in drilling or cutting mode is especially important for using the tool because a continuous coaxial opening is first drilled in the coke mass with the tool from top to bottom before the coke containers are drained as described above. The mode in which the tool is before being introduced, is generally unknown. Without any clear knowledge of whether the tool is actually in drilling mode as required, drainage of a filled coke drum should not be initiated.

The object is therefore to create a possibility for the operating personnel to obtain a clear understanding of whether the tool is in drilling or cutting mode independent of whether the tool is just being introduced, or whether the draining of the drum should be continued.

SUMMARY OF THE INVENTION

On the basis of the initially described tool, this object is achieved by arranging at least one position element on the control device that displays the angular position of the control device in the tool's drilling and cutting mode through a window in the housing.

According to the invention, the control device hence bears at least one position element that is perceptible through a window in the tool housing and shows the operating personnel the angular position of the control device that is assigned to the tool drilling and/or cutting mode.

There are various options for the display that the operating personnel is granted when looking through the window in the housing. Accordingly, a position element can be affixed to the control device such that perceiving it through the window in the housing only indicates the tool drilling mode when the tool is in drilling mode. If the position element cannot be seen when looking through the window in the housing, it means that the tool is not in drilling mode but rather in cutting mode. Conversely, it can also be established that the position element shows that the tool is in cutting mode when looking through the window in the housing. With this option, it cannot be excluded with absolute certainty that the position element cannot be seen, because the switchover is defective.

It is therefore preferable to arrange two position elements on the control device that are different from each other and offset from each other at an angle, of which a first position element is assigned to the display of the angular position of the control device in the tool's drilling mode, and a second position element is assigned to the display of the angular position of the control device in the tool's cutting mode. The angle at which the two position elements on the control device are offset from each other is normally 90° when the valve device controlled by the control device comprises a total of four valve openings, that is, one pair for the tool's drilling mode and another pair for the tool's cutting mode.

The angular position of the control device and the tool mode that is thereby set in each case is more reliable for the operating personnel when each of the two end positions of the control device offset by 90° is assigned a specific position element that is perceptible through the window in the housing.

The two position elements are distinguishable from each other by affixing a "D" for drilling, i.e., for drilling mode, on the first position element, and a "C" for cutting, i.e., for cutting mode, on the second position element.

It is preferable for a variable display element to be arranged in the window of the housing at the height of the control device, the display element being controlled by the position element. By means of this development of the invention, the display of the respective angular position of the control device can be directly moved into the window of the housing where it is even more perceptible, and is controlled by the positioned element on the control device depending upon the angular position thereof, and is correspondingly variably designed to this end, i.e., to distinguish which tool mode is set and therefore displayed. In addition, because the display element is arranged in the window of the housing, it lies outside of the water charging to which the control device and hence the position elements are exposed.

Preferably, the display element consists of a two-pole display solenoid that is adjustable by the position element, which is also designed as a solenoid, into a display position for drilling mode or into a display position for cutting mode depending on the angular position of the control device. This effectuates a secure magnetic link between each position element and the display solenoid. When using two position elements offset from each other at an angle, it is expedient to assign one of the two the adjustment of the display solenoid into drilling mode, and the other position element the shifting of the control device into cutting mode.

The adjustment of the display solenoid by the position elements can be instigated by a displacement of the display solenoid mounted in the window of the housing. It is, however, preferable for the display solenoid for displaying drilling or cutting mode to be rotatably mounted in the window of the housing. A correspondingly identified side of the display solenoid can thereby be assigned to the drilling mode, and the opposite side can be assigned to the cutting mode. The rotatable mounting can for example consist of a simple pivot pin bearing, wherein a disk is located on the pin, the front side of which is, for example, assigned to the drilling mode, and the backside is assigned to the cutting mode and is correspondingly identified.

A very important development of the invention consists in fastening, in a sealed manner, an enclosed insert in the window of the housing, the display element being arranged therein and perceivable from the outside. This measure prevents the display element from being exposed to the high pressure in the housing that, as is known, can range around 300 bar, and also from being exposed to the water flow. Any damage to the display solenoid is prevented by this encapsulation in the sealed insert.

According to an alternative development of the invention, a pressure-resistant transparent element is arranged sealed in the window and permits a view of the at least one position element. A high-strength safety glass, for example, is possible as the material for the transparent element which is designed for a water pressure of at least 300 bar depending on the maximum operating pressure of the tool.

The window in the housing is preferably closable with a flap that can be easily opened to inspect the angular position of the control device. The flap protects the window from damage, especially when the tool is operating.

BRIEF DESCRIPTION OF THE DRAWINGS

Exemplary embodiments of the invention will be described below with reference to the drawings. The drawings show.

DETAILED DESCRIPTION

Figure 3:
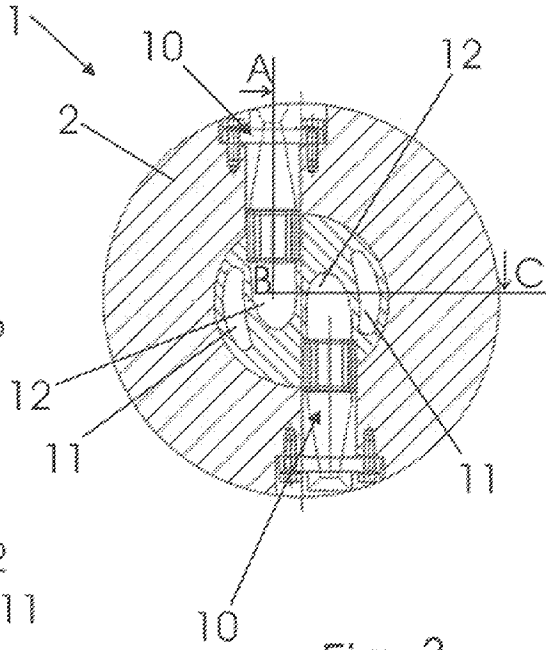
FIG. 3 a cross-section of the tool from FIG. 1 along section line I-II from FIG. 1.
Figure 2:
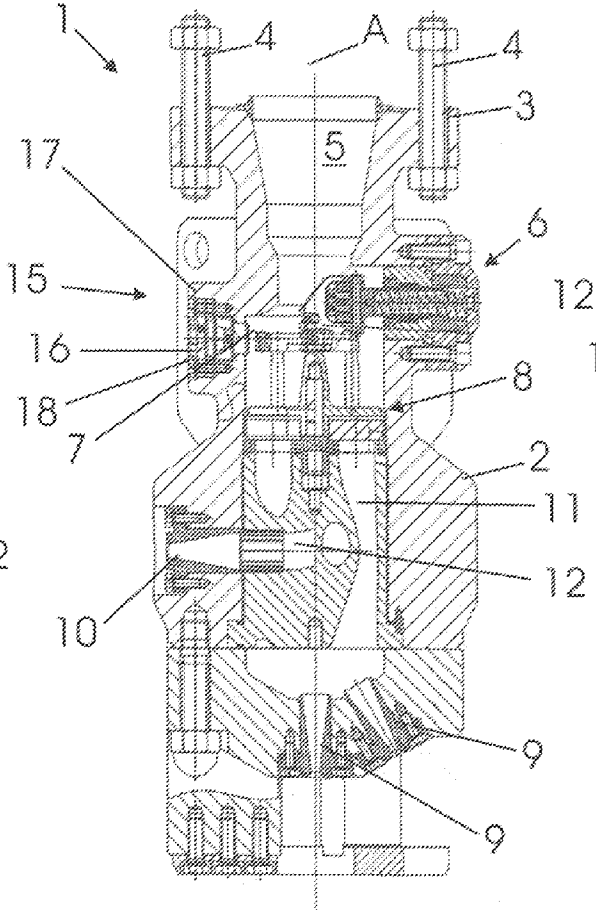
FIG. 2 a depiction of a tool for decoking as in FIG. 1 in a longitudinal section, but in cutting mode.
Figure 1:
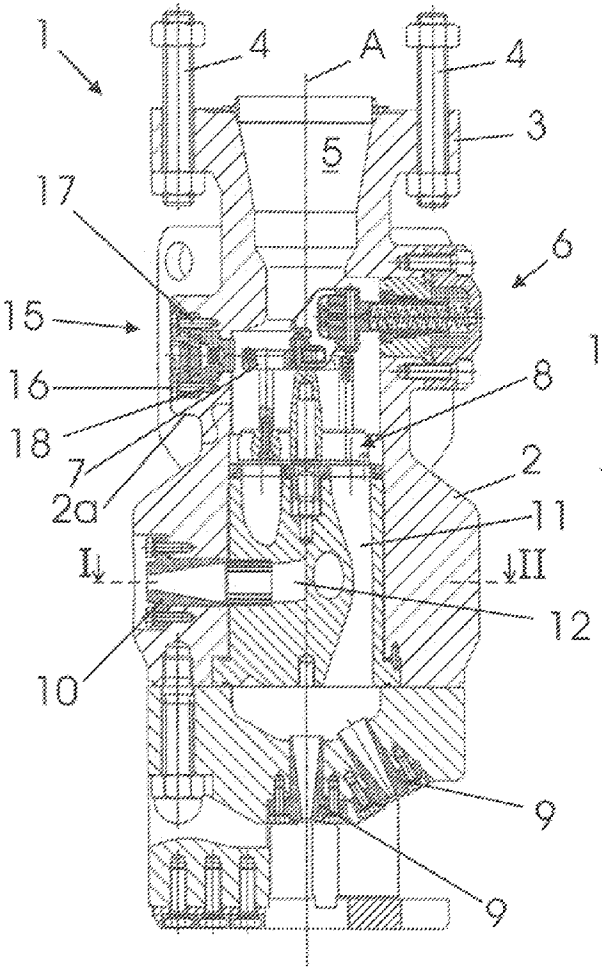
FIG. 1 a depiction of a tool for decoking in a longitudinal section in drilling mode along section lines A-B-C from FIG. 3.

FIG. 1-3 reveal a tool 1 for decoking with a known basic design; accordingly, the tool 1 will only be briefly described in the following before addressing in greater detail the exemplary embodiments according to the invention in FIG. 4-10.

The tool 1 has a housing 2 with a longitudinal axis A that can be attached by a flange 3 using screws 4 to a mating flange of a drill rod (not shown) and consists of a nonmagnetic cast steel.

The tool 1 has a water supply 5 that extends downward from the flange 3 and, while the tool 1 is operating, supplies water under high pressure of, for example, approximately 300 bar which flows via a valve device 8 and channels 11, 12 to drilling nozzles 9 and cutting nozzles 10 arranged in the housing 2 in a known manner. The valve device 8 can be switched by means of a control 6 and a control device 7 from a drilling mode (FIG. 1) to a cutting mode (FIG. 2), and vice versa.

In the drilling mode (FIG. 1) of the control device 7, the water flows through the water supply 5 and the channels 11 to the drilling nozzles 9 from which it exits in the form of high-pressure water jets to crush the coke. The channels 12 to the cutting nozzles 10 are closed by the valve device 8.

When the tool 1 is switched by the control 6 and the control device 7 from drilling mode (FIG. 1) to cutting mode (FIG. 2), the water flows from the water supply 5 through the valve device 8 and the channels 12 toward the cutting nozzles 10 from which corresponding high-pressure water jets exit to cut the coke while the channels 11 to the drilling nozzles 9 are closed.

This design of the tool 1 and its mode of operation illustrate the importance of the operating personnel knowing whether the tool 1 is in cutting mode or drilling mode.

FIG. 1 and FIG. 2 show that an insert 15 is affixed sealed by means of screws of 16, 17 in a window 18 of a projection 2*a* of the housing 2 at the height of the control device 7, and the insert design can be seen in the representations in FIG. 4-7.

Figure 7:
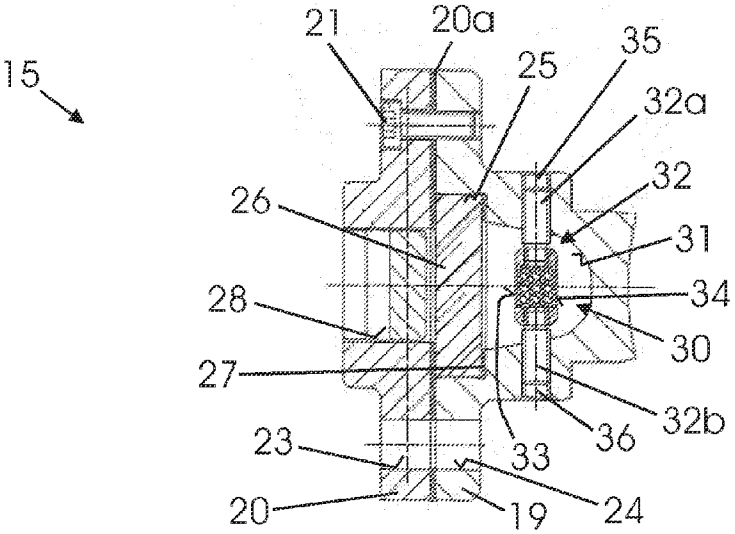
FIGS. 5, 6 and 7 partially sectional views of an insert that can be inserted in a window of a housing of the tool.
Figure 6:
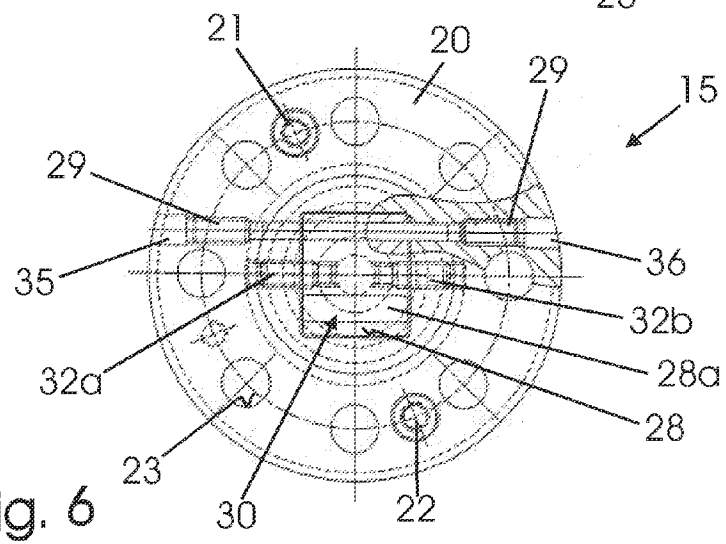
Figure 5:
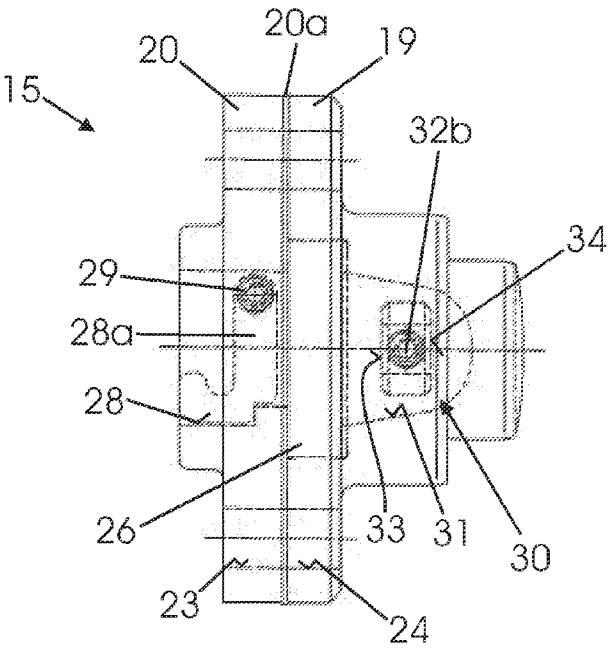

As can be seen in particular in FIG. 5-7, the insert 15 consists of a first and a second housing half 19, 20 that each have a circular shape, between which is a seal 20*a*, and that are connected to each other by screws 21, 22. A ring of holes 23, 24 in the first and second housing half 19, 20 is for accommodating the screws 16, 17 for attaching the insert 15 in the window 18 of the housing 2.

The second housing half 20 has a central and continuous opening 28 that is closable by a flap 28*a* which can be swung up by a pin bearing 29 for a view through the opening 28.

In the first housing half 19, there is a cutout 25 in which an inspection window 26 is inserted that is sealed on both sides, that is, on one side by the seal 20*a* and on the opposite side by an annular seal 27.

Abutting the cutout 25 is a recess 31 in the first housing half 19 in which a display element 30 designed as a solenoid is pivotably mounted on a pin 32 with pin ends 32*a*, 32*b* that are rotatably mounted in bearing holes 35, 36 of the first housing half 19. On one side, the disk-like display element 30 has a south pole 33 and, on the opposite side, a north pole 34.

Figure 4:
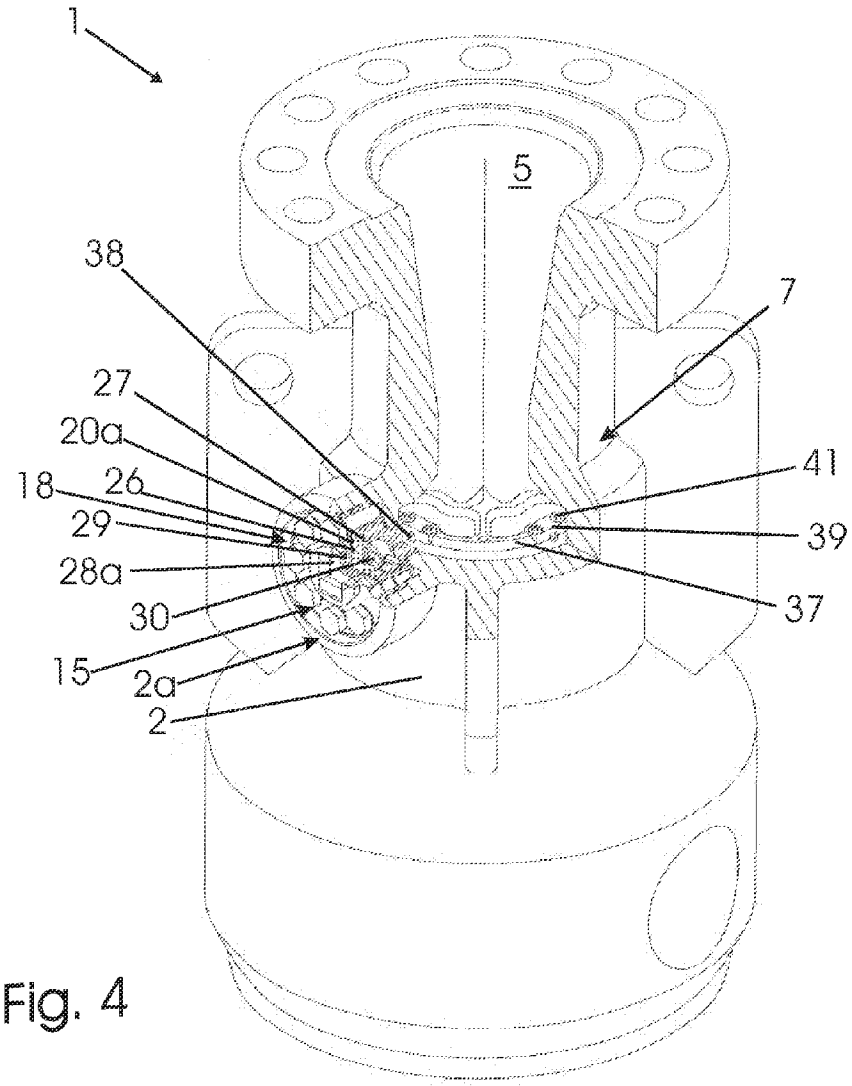
FIG. 4 a partial view of the tool from FIGS. 1 and 2, partially in section to depict a display for a tool drilling and cutting mode.
Figure 9:
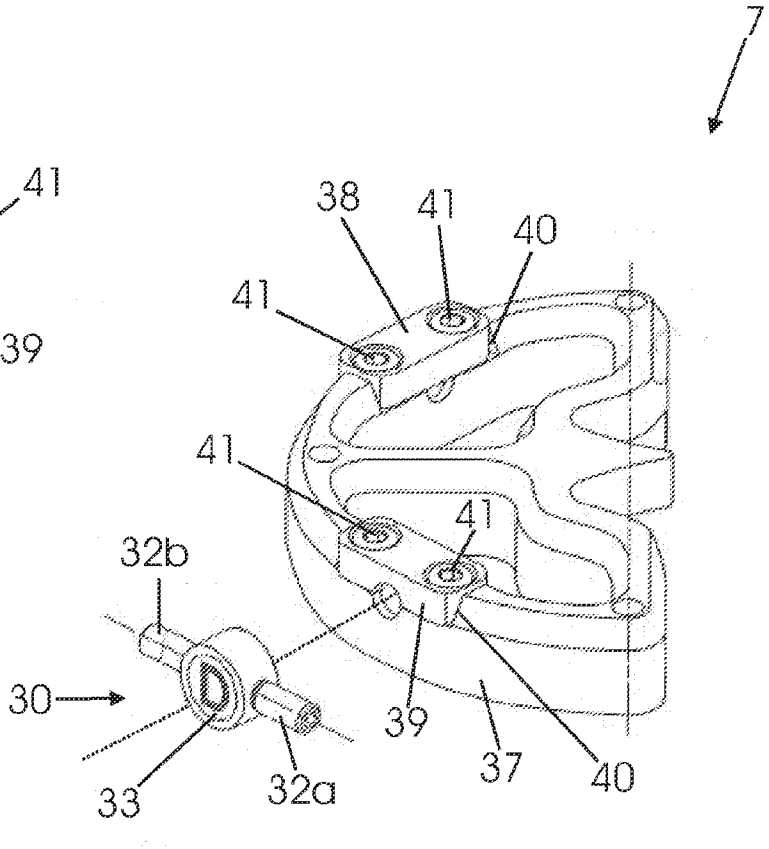
FIG. 9 a depiction of the control device and the display element as in FIG. 8, but in drilling mode in this case.
Figure 8:
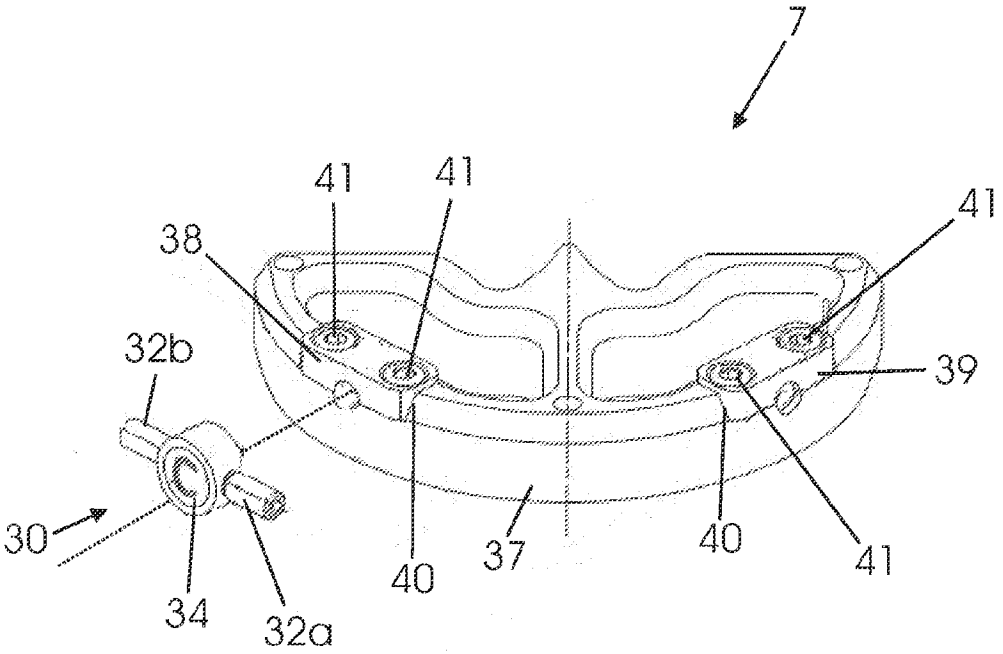
FIG. 8 a schematic and perspective view of a part of a control device and a display element in cutting mode.

It can be seen in particular in FIG. 4 that the insert 15 is inserted with the display element 30 into the projection 2*a* of the housing 2 of the tool 1 and interacts with the control device 7. The supplementary views in FIGS. 8 and 9 show the switchover by the control device 7 from a cutting mode (FIG. 8) to a drilling mode (FIG. 9).

On an arc element 37 that is adjustable by means of the control device 7 between two angular positions, two position elements 38, 39 offset from each other by 90° are inserted into a recess 40 in the edge of the arc element 37 and are fastened with screws 41. The position elements 38, 39 are also designed as a solenoid like the display element 30. Their magnetic effect and their assignment to the display element 30 is configured such that the first position element 38 rotates the north pole 34, identified with "C", of the display element 30 outward into the cutting mode of the tool 1, and the second position element 39 rotates the south pole 33 of the display element 30 outward when the arc element 37, as a consequence of the tool 1 being switched, is swung from cutting mode (FIG. 8) into drilling mode (FIG. 9). The south pole 33 of the display element 30 for the drilling mode is correspondingly identified with "D" for "drilling", whereas the north pole 34 for the cutting mode is identified with "C".

In this manner, the operating personnel, after opening the flap 28*a* in the opening 28, can discern by the then legible letters "C" or "D" on the display element 30 whether the tool 1 is in cutting mode or drilling mode by a corresponding angular position of the control device 7.

Figure 10:
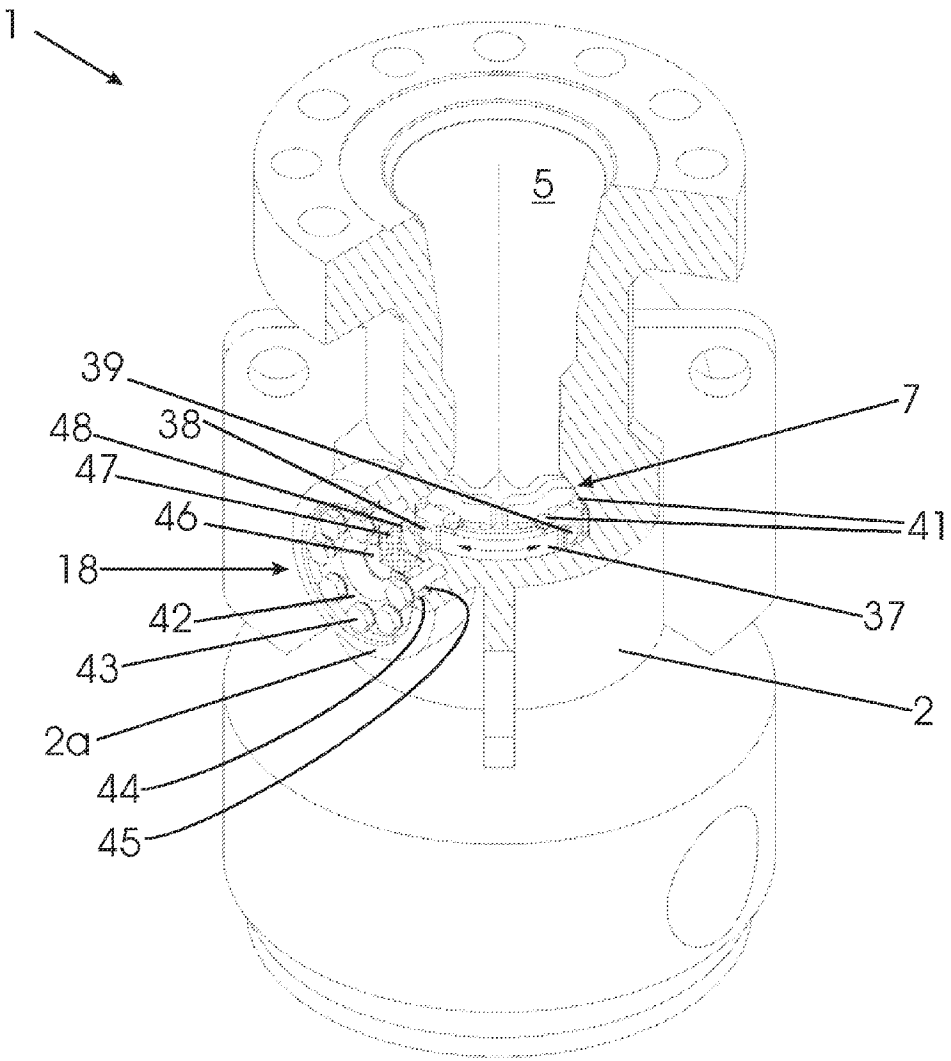
FIG. 10 a depiction of a partial view of the tool as in FIG. 4, in this case however with an alternative embodiment of a display device with a transparent element in a window in the housing of the tool.

The alternative embodiment shown in FIG. 10 to display whether the tool 1 is in drilling or cutting mode basically differs in that the display element 30 is omitted and, instead, a direct possibility is created for freely viewing the position elements 38', 39' from the outside, wherein the outer sides of the position elements 38', 39' already bear the symbol for the cutting or drilling mode, i.e., the letter "C" on position element 38' for the cutting mode, and the letter "D" on the positioned element 39' for the drilling mode. Apart from that, no change has been made to the control device 7 and its arc element 37 relative to the first exemplary embodiment as shown in FIG. 4.

In this exemplary embodiment as well, an insert 42 is fastened by means of screws 43 in a cutout 44 corresponding to the window 18 and is sealed by means of a seal 45 in the cutout 44.

The insert 42 has a centrally arranged, pressure-resistant and transparent element 46 being a disk-shaped pane of high-strength safety glass that can easily withstand the operating pressure of the high-pressure water flowing through the tool 1 of 300-400 bar. The element 46 is located in an opening 47 in the insert 42 and is sealed by a seal 48 from the annular housing step.

This arrangement ensures that the insert 42 is manufactured as a whole and is inserted with the transparent element 46 consisting of a disk-shaped pane made of safety glass into the window 18 or the cutout 44 in the housing projection 2*a*, and is fastened there sealed by the ring of screws 43.

When the tool 1 is in cutting mode as depicted in the exemplary embodiment in FIG. 10, the position element 38' with the letter "C" on its outside lies directly opposite the element 46, that is the disk-shaped pane made of safety glass, such that the operating personnel can perceive the letter "C" when viewing through the element 46 and can thereby deduce that the tool 1 is in cutting mode. Correspondingly, the letter "D" can be perceived by the operating personnel in a position directly opposite the element 46 or the disk-shaped pane made of safety glass when the tool 1 is in drilling mode.

Also in this exemplary embodiment, as with the first exemplary embodiment, a flap 28*a* can be affixed on the outside in front of the element 46 to protect the disk-shaped pane, and it can be swung up when a view through the element 46 is desired.

The invention claimed is:

1. A tool for crushing coke, comprising:

a housing (2) that, in an operating state, is fastened to a drill rod, and in which at least one cutting nozzle (10) for cutting and a drilling nozzle (9) for drilling coke by a water jet, and a control for supplying water flowing through the housing (2) under pressure for drilling or cutting is arranged, wherein a control for switching the tool (1) from a drilling mode to a cutting mode and vice versa comprises a control device (7) that is rotatable about a longitudinal axis (A) of the housing (2) to switch the tool (1), wherein the drilling or cutting mode is set depending on angular position of the control device (7), wherein at least one position element (38, 39) is arranged on the control device (7) that displays the angular position of the control device (7) in the drilling and/or cutting mode of the tool (1) through a window (18) in the housing (2), wherein two position elements (38, 39) are arranged on the control device (7) that are different from each other and offset from each other at an angle, of which a first position element (38) is assigned to the display of the angular position of the control device (7) in the drilling mode of the tool (1), and a second position element (39) is assigned to the display of the angular position of the control device (7) in the cutting mode (1).

2. The tool according to claim 1, wherein a variable display element (30) is arranged in the window (18) of the housing (2) at a height of the control device (7) and is controlled by at least one of the position elements (38, 39).

3. The tool according to claim 2, wherein the display element (30) consists of a display solenoid that is adjustable by the at least one position element (38, 39) which is also designed as a solenoid, into a display position for drilling mode, or into a display position for cutting mode, depending on the angular position of the control device (7).

4. The tool according to claim 3, wherein the display element (30) designed as a display solenoid is rotatably mounted in the housing (2) to display the drilling or cutting mode.

5. The tool according to claim 2, wherein an enclosed insert (15) is sealed in the window (18) of the housing (2), and the display element (30) is arranged therein and is perceivable from the outside.

6. The tool according to claim 1, wherein a pressure-resistant transparent element (46) is arranged sealed in the window (18) and permits a view of the at least one position element (38, 39).

7. The tool according to claim 6, wherein a flap (28*a*) is affixed outside the element (46) which can be swung up for a view through the element (46).

8. The tool according to claim 1, wherein an enclosed insert (15) is sealed in the window (18) of the housing (2), and a continuous opening (28) in the insert (15) can be closed with a flap (28*a*).

* * * * *